US007048580B2

(12) United States Patent
Kobayashi

(10) Patent No.: US 7,048,580 B2
(45) Date of Patent: May 23, 2006

(54) WATERPROOF PLUG FOR WATERPROOF CONNECTOR

(75) Inventor: Toru Kobayashi, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/941,107

(22) Filed: Sep. 15, 2004

(65) Prior Publication Data

US 2005/0059294 A1 Mar. 17, 2005

(30) Foreign Application Priority Data

Sep. 17, 2003 (JP) ..... P.2003-323950

(51) Int. Cl.
*H01R 13/40* (2006.01)

(52) U.S. Cl. ..... 439/587

(58) Field of Classification Search ..... 439/587, 439/589, 274, 275

See application file for complete search history.

(56) References Cited

U.S. PATENT DOCUMENTS 4,973,268 A * 11/1990 Smith et al. ..... 439/595
5,551,892 A * 9/1996 Endo et al. ..... 439/587
5,707,251 A * 1/1998 Sakai et al. ..... 439/589
6,171,144 B1 * 1/2001 Stone ..... 439/587

FOREIGN PATENT DOCUMENTS

JP 2001-357927 A 12/2001

* cited by examiner

*Primary Examiner*—Khiem Nguyen
(74) *Attorney, Agent, or Firm*—Sughrue Mion, PLLC

(57) ABSTRACT

A waterproof plug for a waterproof connector, includes a body portion which has a substantially cylindrical shape, and has a first end and a second end which is opposite side of the first end, and an enlarged portion, which is formed on the first end of the body portion in coaxial relation thereto. A slanting face is formed on an outer face of the enlarged portion so that the enlarged portion decreases in a diameter from a side of the second end to a side of the first end.

2 Claims, 2 Drawing Sheets

WATERPROOF PLUG FOR WATERPROOF CONNECTOR

BACKGROUND OF THE INVENTION

This invention relates to a waterproof plug for a waterproof connector.

A waterproof connector includes a housing in which a terminal connecting a cable is received. The housing includes a receiving chamber for receiving the terminal, an opening through which the interior and exterior of the housing communicate with each other, and a communication portion through which the opening and the receiving chamber communicate with each other. The cable can be connected to the terminal through this opening. A rubber plug, having a through hole (in which the cable can be press-fitted) is used as a waterproof seal, and is fitted in the housing. An inner surface of the through hole is corrugated in a direction of the axis of the through hole, and has larger-diameter portions and smaller-diameter portions. The smaller-diameter portions are designed to have a diameter smaller than the outer diameter of the cable, and the smaller-diameter portions are adapted to be held in intimate contact with the cable because of their own elasticity, thereby preventing water from intruding into the housing.

When the cable is not connected to the waterproof connector, a waterproof plug of a cylindrical shape, having the same diameter as that of the cable, is press-fitted in the through hole (through which the cable is to be passed) in the rubber plug to close this through hole. In order to prevent such a waterproof plug from being disengaged from the rubber plug, there has been proposed a construction in which a pair of retaining projections are formed at each of opposite ends of the waterproof plug, and project symmetrically respectively in opposite directions perpendicular to the axis of the waterproof plug, and these retaining projections restrict the axial movement of the waterproof plug (see, for example, JP-A-2001-357927, especially, pages 2 to 3, FIGS. 1 to 2). Crest surfaces of the retaining projections, formed at one end portion of this waterproof plug, are slanting and tapering toward a tip or distal end thereof, and this tapering end portion is inserted into the through hole, thereby attaching the waterproof plug to the rubber plug.

However, when the waterproof plug, described in JP-A-2001-357927, is inserted into the through hole in the rubber plug, there is a fear that the smaller-diameter portions (that is, lip portions) on the inner surface of the through hole are damaged by the retaining projections formed at the end portions of the waterproof plug. When the lip portions are thus damaged, the ability of the rubber plug to be held in intimate contact with the cable or the waterproof plug is deteriorated, which leads to a possibility that the waterproof performance of the rubber plug is lowered.

SUMMARY OF THE INVENTION

An object of this invention is to prevent a waterproof performance of a rubber plug of a waterproof connector from being lowered.

The present invention has solved the above problem by the following means. More specifically, according to the invention, there is provided a waterproof plug for a waterproof connector, comprising;

a body portion, which has a substantially cylindrical shape, and has a first end and a second end which is opposite side of the first end; and an enlarged portion, which is formed on the first end of the body portion in coaxial relation thereto, wherein a slanting face is formed on an outer face of the enlarged portion so that the enlarged portion decreases in a diameter from a side of the second end toward a side of the first end.

According to the present invention, there is also provided a waterproof plug for a waterproof connector including a housing and an elastic plug, the housing having a receiving chamber for receiving a terminal connected to a cable, an opening, a communication portion through which the opening and the receiving chamber communicate with each other, and a slanting portion formed between the communication portion and the receiving chamber, and the elastic plug having a through hole for being passed through the cable and the elastic plug being press-fitted in the communication portion, the waterproof plug, comprising:

a body portion, which has a substantially cylindrical shape, and has a first end and a second end which is opposite side of the first end; and an enlarged portion, which is formed on the first end of the body portion in coaxial relation thereto, wherein a slanting face is formed on an outer face of the enlarged portion so as to correspond to the slanting portion so that the enlarged portion decreases in a diameter from a side of the second end toward a side of the first end;

wherein instead of the cable, the body portion is fitted in the through hole of the elastic plug; and wherein the slanting face of the enlarged portion is bring into contact with the slanting portion of the housing when the elastic plug is press-fitted in the communication portion of the housing.

The waterproof connector includes a housing in which a receiving chamber for receiving a terminal, connected to a cable, is formed, and a communication portion through which an opening (formed in the housing) and the receiving chamber communicate with each other, and a slanting portion is formed between the communication portion and the receiving chamber, and is decreasing in diameter gradually away from the opening toward the receiving chamber, and a rubber plug, having a through hole formed therethrough at an axis thereof, is press-fitted in the communication portion.

The waterproof plug for use in the waterproof connector includes the substantially-cylindrical body portion, and the bell-like enlarged-diameter portion formed at one end of the cylindrical body portion in coaxial relation thereto, and the outer periphery of the enlarged-diameter portion is smaller than an inner diameter of the communication portion. The slanting surface is formed at the outer periphery of the enlarged-diameter portion, and is increasing in diameter gradually from the one end of the body portion (at which the enlarged-diameter portion is formed) toward the other end of the body portion facing away from the one end thereof, and the slanting surface is formed to correspond to the slanting portion. When the cable is not passed through the through hole in the rubber plug of the waterproof connector, the waterproof plug is attached to the waterproof connector in such a manner that the slanting surface of the enlarged-diameter portion is held against the slanting portion, with the cylindrical body portion press-fitted in the through hole in the rubber plug of the waterproof connector.

With this construction, the waterproof plug can be attached to the waterproof connector merely by inserting only the cylindrical body portion of this waterproof plug into the through hole in the elastic plug, and therefore lip portions of the elastic plug will not be damaged at the time of attaching the waterproof plug, and the lowering of the waterproof performance due to damage of the lip portions is prevented.

And besides, the enlarged-diameter portion of the waterproof plug is located within the housing, and is held between the inner wall of the housing and the elastic plug, and by doing so, the waterproof plug is prevented from being withdrawn toward the opening in the housing, and also is prevented from being withdrawn toward the receiving chamber of the housing. In this case, the slanting surface of the enlarged-diameter portion is fitted in the slanting portion formed between the communication portion and the receiving chamber, thereby suppressing the shaking of the waterproof plug, and therefore the lowering of the waterproof performance of the elastic plug due to this shaking is suppressed.

The elastic plug can be detachably retained in the opening portion of the housing. The elastic plug-attaching operation is carried out according to the following procedure. The elastic plug is removed from the housing, and the waterproof plug is mounted in a tubular portion of the housing, and the elastic plug is press-fitted into the communication portion, with the cylindrical body portion of the waterproof plug press-fitted in the through hole in the elastic plug, thus retaining the elastic plug in the opening portion.

In this case, there can be used a construction in which retaining projections are formed on the outer periphery of the elastic plug, and recesses, corresponding respectively to the retaining projections, are formed in the opening portion of the housing, and the retaining projections are retainingly engaged in the recesses, respectively. That portion of the elastic plug on which the retaining projections are formed can be made of a material different in elastic modulus from rubber. For example, in the case where this portion on which the retaining projections are formed is made of a relatively-stiff material such as a resin, the cylindrical body portion of the waterproof plug is inserted in a through hole in this resin portion when the waterproof plug is attached to the waterproof connector.

In the present invention, the waterproof performance of the elastic plug of the waterproof connector is prevented from being lowered.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
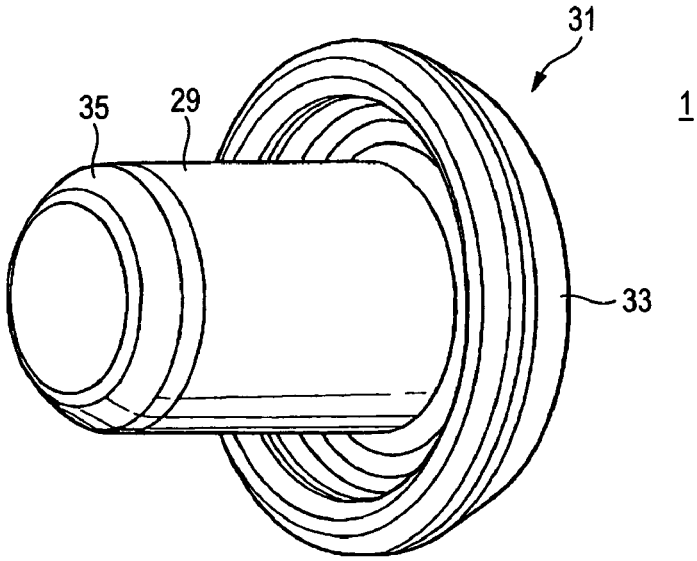
FIG. 1 is a perspective view showing a shield pin of the present invention.
Figure 2:
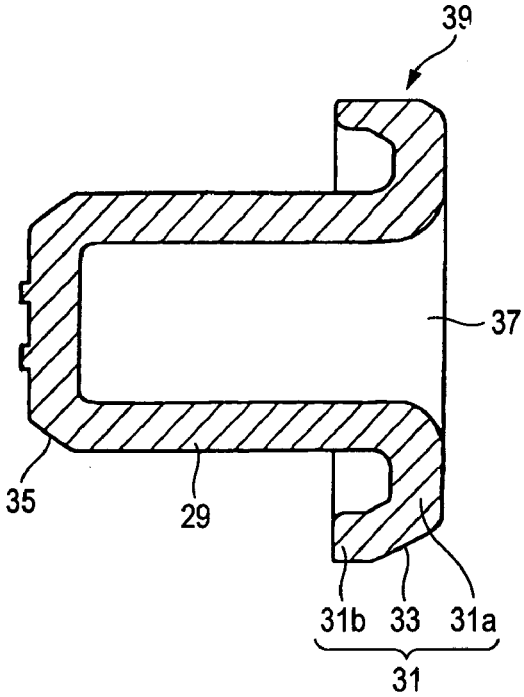
FIG. 2 is a cross-sectional view of the shield pin of the invention cut along an axis of a cylindrical body portion of the shield pin.
Figure 3:
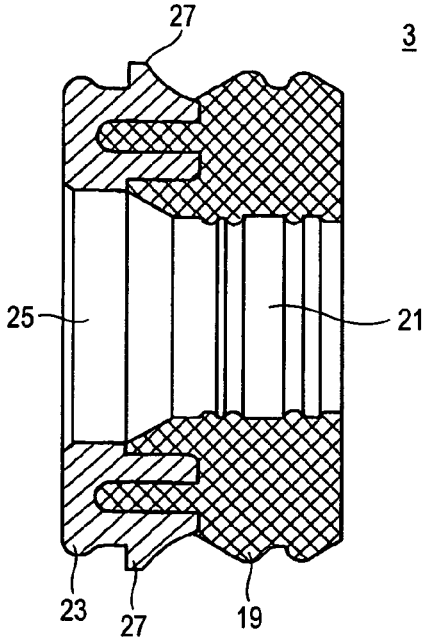
FIG. 3 is a cross-sectional view of a rubber plug of a waterproof connector cut along an axis thereof.
Figure 4:
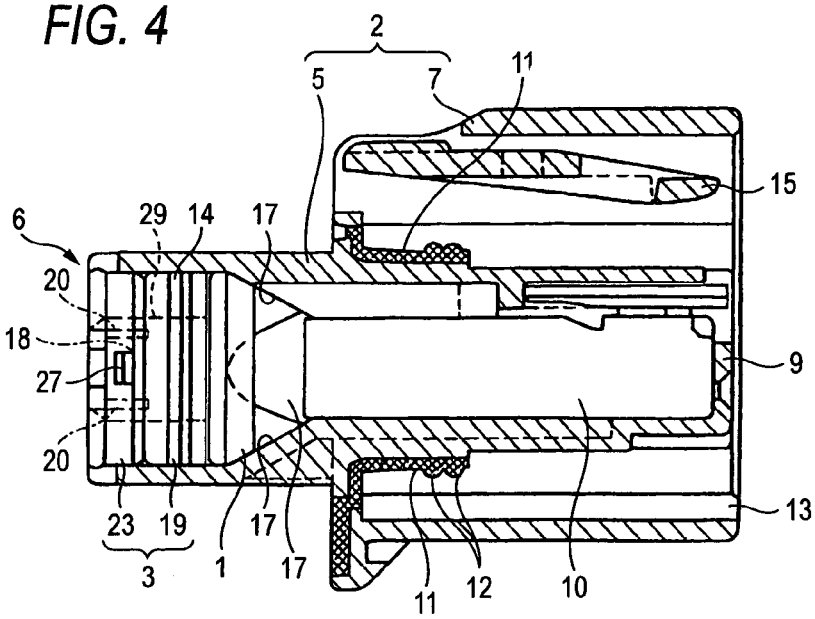
FIG. 4 is a cross-sectional view showing the overall construction of the waterproof connector.

A preferred embodiment of a shield pin of the present invention, serving as a waterproof plug for a waterproof connector, will now be described with reference to FIGS. 1 to 4. FIG. 1 is a perspective view showing the shield pin of the invention. FIG. 2 is a cross-sectional view of the shield pin of the invention cut along an axis of a cylindrical body portion of the shield pin. FIG. 3 is a cross-sectional view of a rubber plug of the waterproof connector cut along an axis thereof. FIG. 4 is a cross-sectional view showing the overall construction of the waterproof connector.

As shown in FIG. 4, the waterproof connector in which the shield pin 1 is used includes a connector housing 2 and the rubber plug 3. The connector housing 2 includes a tubular portion 5 and a tubular portion 7. An opening 6 is formed in one end of the tubular portion 5, and a cable can be introduced into the housing through this opening 6. A receiving chamber 10 for receiving a terminal 9 (to which the cable is connected) is formed in the other end portion of the tubular portion 5. Here, that portion of the tubular portion 5 through which the opening 6 and the receiving chamber 10 communicate with each other will be referred to as a communication portion 14.

An inner periphery of the tubular portion 7 is larger in size than an outer periphery of the tubular portion 5, and an axial length of the tubular portion 7 is smaller than that of the tubular portion 5. The tubular portion 7 is disposed in surrounding relation to that portion of the tubular portion 5 extending from an intermediate portion thereof to one end thereof disposed immediately adjacent to a distal end of the terminal 9. One end of the tubular portion 7, disposed at the intermediate portion of the tubular portion 5, is joined to the outer periphery of the tubular portion 5 such that the tubular portions 5 and 7 are molded into an integral construction. A band member 11, made of rubber, is affixed to that portion of the outer peripheral surface of the tubular portion 5, extending a predetermined distance from this joint portion toward the distal end of the terminal 9, over the entire periphery thereof. Two annular convex portions or ridges 12 are formed on an outer peripheral surface of the band member 11 over an entire periphery thereof. When the waterproof connector of this embodiment is connected to a mating connector (not shown), these convex portions 12 are press-fitted into a tubular portion of the mating waterproof connector, thereby preventing water from intruding into that portion of the tubular portion 5 receiving the terminal 9. A groove 13 is formed in the inner periphery of the tubular portion 7, and extends along the axis thereof so as to guide the mating waterproof connector. A retaining portion 15 is formed on the inner periphery of the tubular portion 7, and can be retainingly engaged with a retaining portion formed on the outer periphery of the tubular portion of the mating waterproof connector.

Next, the construction of the characteristic portions of this embodiment will be described. A cross-section of the communication portion 14 (i.e., that portion of the tubular portion 5 extending from the opening 6 to the receiving chamber 10 for the terminal 9), disposed perpendicular to the axis of the tubular portion 5, has a round shape. On the other hand, a cross-section of the receiving chamber 10, disposed perpendicular to the axis of the tubular portion 5, has a square shape. The square cross-section of the receiving chamber 10 is smaller than the round cross-section of the communication portion 14. A slanting portion 17 is formed between the communication portion 14 and the receiving chamber 10. The slanting portion 17 is formed by four surfaces extending respectively from inner ends of four inner surfaces (defining the receiving chamber 10), disposed close to the opening 6, toward the opening 6 in such a manner that the slanting portion 17 is gradually increasing in diameter toward the opening 6. The four surfaces of the slanting portion 17 are inclined at the same angle relative to the axis of the tubular portion 5, and merge into the cylindrical inner surface of the communication portion 14 at the region where these four surfaces intersect this cylindrical inner surface. Retaining holes 18 (one of which is indicated in a dot-and-dash line in FIG. 4) are formed through that portion of the tubular portion 5 disposed adjacent to the opening 6. The two retaining holes 18 are arranged symmetrically, with the axis of the tubular portion 5 disposed therebetween. Grooves 20 are formed at opposite sides of each retaining hole 18, and extend from the cable introducing-side end of the tubular portion 5 to the vicinity of the retaining hole 18, and therefore those portions of the tubular portion in which the retaining holes 18 are formed, respectively, can be easily elastically deformed in the direction perpendicular to the axis of the tubular portion 5.

As shown in FIG. 3, the rubber plug 3 of the waterproof connector includes a rubber plug body 19 of a cylindrical shape made of rubber, and this rubber plug body 19 has a through hole 21 formed therethrough at an axis thereof. An outer periphery of the rubber plug body 19 is corrugated in the axial direction, and has larger-diameter portions and smaller-diameter portions. The outer diameter of the larger-diameter portions is larger than the inner diameter of the communication portion 14 by an amount corresponding to a press-fitting margin. Similarly, the inner surface of the through hole 21 is corrugated in the axial direction, and has larger-diameter portions and smaller-diameter portions. The diameter of the smaller-diameter portions is smaller than the outer diameter of the cable by an amount corresponding to a press-fitting margin. This press-fitting margin is suitably determined by the elastic modulus of the rubber, the dimensions of the rubber plug, etc. A cylindrical resin portion 23 is connected to one end of the rubber plug body 19 in coaxial relation thereto. The cylindrical resin portion 23 has a through hole 25 formed therethrough at an axis thereof, the through hole 25 having an inner diameter larger than the outer diameter of the cable. Two retaining claws 27 are formed on the outer periphery of the resin portion 23, and are arranged symmetrically, with the resin portion 23 disposed therebetween. The retaining claws 27 can be retainingly engaged respectively in the retaining holes 18 formed in the end portion of the tubular portion 5 disposed adjacent to the opening 6.

As shown in FIGS. 1 and 2, the shield pin 1 for use in the waterproof connector of the construction includes the cylindrical body portion 29, and a bell-like enlarged-diameter portion 31 formed at one end of the cylindrical body portion 29. The enlarged-diameter portion 31 includes an annular portion 31*a* extending from the one end of the body portion 29 and disposed coaxially with this body portion 29, and a tubular portion 31*b* extending in a gradually diameter-increasing manner from an outer periphery of the portion 31*a* toward the other end of the body portion 29 facing away from the one end of this body portion 29 from which the portion 31*a* extends. The maximum diameter of the enlarged-diameter portion 31 is equal to or smaller than the inner diameter of the introducing-side cylindrical portion of the tubular portion 5. A slanting surface 33 is formed at the outer periphery of the enlarged-diameter portion 31 of the shield pin 1, and this slanting surface 33 increases in diameter gradually from the one end of the body portion 31 (at which the enlarged-diameter portion 31 is formed) toward the other end of the body portion 29 facing away from the one end thereof. The slanting surface 33 is formed so as to correspond to the surfaces of the slanting portion 17 within the tubular portion 5. Namely, the angle of the slanting surface 33 of the enlarged-diameter portion 31 relative to the axis of the tubular portion 5 is the same as the angle of the surfaces of the slanting portion 17 (formed within the tubular portion 5) relative to the axis of the tubular portion 5. The other end of the body portion 29, facing away from the one end of this body portion 29 at which the enlarged-diameter portion 31 is formed, is chamfered as at 35. As shown in FIG. 2, a hollow portion 37 is formed within the body portion 29. Part of the enlarged-diameter portion 31 is notched to form a notched portion 39. This portion is notched along the axis of the body portion 29 to form the notched portion 39.

Next, a procedure of attaching the shield pin 1 of this embodiment to the waterproof connector will be described. First, the retaining claws 27 of the rubber plug 3 are disengaged from the retaining holes 18, respectively, and the rubber plug 3 is drawn from the communication portion 14 of the tubular portion 5. Then, that side of the shield pin 1, having the enlarged-diameter portion 31, is inserted into the tubular portion 5, and the slanting surface 33 of the enlarged-diameter portion 31 is brought into abutting engagement with the surfaces of the slanting portion 17, and is held by theses surfaces. As a result, the cylindrical body portion 29 of the shield pin 1 is disposed to project toward the introducing port in the tubular portion 5. The through hole 21 in the rubber plug 3 is aligned with the thus projecting body portion 29, and then the rubber plug 3 is press-fitted into the tubular portion 5, and at the same time the cylindrical body portion 29 is inserted into the through hole 21 of the rubber plug 3. After the rubber plug 3 is inserted into the communication portion 14 of the tubular portion 5, the retaining claws 27 of the rubber plug 3 are retainingly engaged respectively in the retaining holes 18 in the tubular portion 5, thus finishing the attaching operation.

As described above, in this embodiment, the shield pin 1 can be attached to the waterproof connector merely by inserting only the cylindrical body portion 29 of the shield pin 1 into the through hole 21 in the rubber plug 3, and therefore the lip portions of the rubber plug 3 will not be damaged at the time of attaching the shield pin 1, and the lowering of the waterproof performance due to damage of the lip portions is prevented. And besides, the enlarged-diameter portion 31 of the shield pin 1 is located within the connector housing 2, and is held between the slanting portion 17, formed within the tubular portion 5 of the connector housing 2, and the rubber plug 3. Therefore, the shield pin 1 is prevented from being drawn toward the outside of the connector housing 2, and also is prevented from being drawn toward the inner side of the connector housing 2. Furthermore, the slanting surface 33 of the enlarged-diameter portion 31 is fitted in the slanting portion 17 formed within the tubular portion 5, so that the shaking of the shield pin 1 is suppressed, and therefore the lowering of the waterproof performance of the rubber plug 3 due to this shaking is suppressed.

In this embodiment, the enlarged-diameter portion 31 includes the annular portion 31*a* extending from the one end of the body portion 29, and the tubular portion 31*b* extending in a gradually diameter-increasing manner from the outer periphery of this portion 31*a* toward the other end of the body portion 29. However, the invention is only required to have such a construction that the enlarged-diameter portion 31 can be held between the rubber plug 3 and the inner wall within the connector housing 2, and the invention is not limited to this embodiment, and any other suitable design can be adopted.

In this embodiment, in order to facilitate the attaching of the shield pin 1, the retaining claws 27 are formed on the rubber plug 3, while the retaining holes 18, corresponding respectively to the retaining claws 27, are formed in the introducing-side end portion of the tubular portion 5 of the connector housing 2. However, the invention is not limited to this construction, and any other suitable retaining mechanism can be used. Furthermore, although the resin portion 23 is provided on the rubber plug 3, the material of which the resin portion 23 is made need only to be stiff enough to form the retaining claws 27, and this part can be made of any other suitable material satisfying this requirement. Furthermore, for example, when the through hole 25 in the resin portion 23 has such an inner diameter as to snugly fit on the body portion 29 of the shield pin 1, the distal end portion of the body portion 29 of the shield pin 1 is held in the through hole 25 when the shield pin 1 is attached to the waterproof connector.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

What is claimed is:

1. A waterproof plug for a waterproof connector, comprising;

a body portion, which has a substantially cylindrical shape, and has a first end and a second end which is opposite side of the first end; and an enlarged portion, which is formed on the first end of the body portion in coaxial relation thereto, wherein a slanting face is formed on an outer face of the enlarged portion so that the enlarged portion decreases in a diameter from a side of the second end toward a side of the first end, wherein said waterproof plug is inserted into a cable receiving hole of an elastic plug as a substitute for a cable and the slanting face contacts a housing in which the elastic plug is received.

2. A waterproof plug for a waterproof connector including a housing and an elastic plug, the housing having a receiving chamber for receiving a terminal connected to a cable, an opening, a communication portion through which the opening and the receiving chamber communicate with each other, and a slanting portion formed between the communication portion and the receiving chamber, and the elastic plug having a through hole for being passed through the cable and the elastic plug being press-fitted in the communication portion, the waterproof plug, comprising:

a body portion, which has a substantially cylindrical shape, and has a first end and a second end which is opposite side of the first end; and an enlarged portion, which is formed on the first end of the body portion in coaxial relation thereto, wherein a slanting face is formed on an outer face of the enlarged portion so as to correspond to the slanting portion so that the enlarged portion decreases in a diameter from a side of the second end toward a side of the first end;

wherein instead of the cable, the body portion is fitted in the through hole of the elastic plug; and wherein the slanting face of the enlarged portion is brought into contact with the slanting portion of the housing when the elastic plug is press-fitted in the communication portion of the housing.

* * * * *